US007219984B2

(12) United States Patent
Tran

(10) Patent No.: US 7,219,984 B2
(45) Date of Patent: May 22, 2007

(54) CONSUMED INK CARTRIDGE REFILLING PROCESS

(76) Inventor: Minh Phuc Tran, 3400 Weston Road, Toronto, Ontario (CA) M9M 2W2

( * ) Notice: Subject to any disclaimer, the term of this patent is extended or adjusted under 35 U.S.C. 154(b) by 304 days.

(21) Appl. No.: 11/002,037

(22) Filed: Dec. 3, 2004

(65) Prior Publication Data

US 2006/0119672 A1 Jun. 8, 2006

(51) Int. Cl.
*B41J 2/17* (2006.01)
*B41J 2/175* (2006.01)

(52) U.S. Cl. ..... 347/84; 347/85

(58) Field of Classification Search ..... 347/21, 347/28, 84, 85; 219/497
See application file for complete search history.

(56) References Cited

U.S. PATENT DOCUMENTS 4,223,324 A * 9/1980 Yamamori et al. ..... 347/21
5,790,147 A * 8/1998 Hensel ..... 347/28
5,793,389 A * 8/1998 Mitchell ..... 347/28
5,933,173 A * 8/1999 Solero ..... 347/85
6,380,522 B1 * 4/2002 Bochud ..... 219/497
6,491,387 B1 * 12/2002 Mayfield ..... 347/84
6,846,070 B2 * 1/2005 Jones et al. ..... 347/85
2001/0013884 A1 * 8/2001 Crystal et al. ..... 347/85

FOREIGN PATENT DOCUMENTS

KR 2002006649 * 1/2002
WO WO 97/07980 * 3/1997

OTHER PUBLICATIONS

"Eight-Station Ink Jet Cartridge Cleaning System Released by R-Jet Tek", Nov. 1, 1998, RECHARGER Magazine, p. 13; http://www.rechargermag.com/article.asp?id=199811163.*

* cited by examiner

*Primary Examiner*—Hai Pham
*Assistant Examiner*—Carlos A. Martinez, Jr.
(74) *Attorney, Agent, or Firm*—David W. Wong

(57) ABSTRACT

In the process of refilling a consumed inkjet printer cartridge, the nozzle and the internal ink carrier medium are cleaned by applying steam under pressure in short burst intervals at the nozzle. The dissolved ink remnant in the cartridge is extracted by a suction device applied over the nozzle. The completely cleaned cartridge is refilled by injecting fresh ink through a refill opening formed in the cartridge casing at a location directly opposite to the nozzle.

3 Claims, 2 Drawing Sheets

CONSUMED INK CARTRIDGE REFILLING PROCESS

BACKGROUND OF THE INVENTION

1. Field of the Invention

This invention relates to a process and system for refilling printer ink cartridges.

2. Background Art

Inkjet printers have gained popularity among computer users in view of their low initial cost and versatility. They also produce letter and graphic prints with high quality. The ink required by printing is provided by ink cartridges mounted to the print head of the printer. Ink is held in a carrier material such as foam fiber located within a cartridge, which is saturated with the ink. The printer extracts the ink from the cartridge by vacuum pressure and delivers it to the print head. Inkjet printers consume printing ink at a fast rate particularly when printing graphics and photographic pictures. As an ink cartridge only holds a limited amount of ink, the cartridges would require replacing frequently. Therefore, the cost of operating an inkjet printer is high with the necessity of having to replace the ink cartridges frequently. Furthermore, the spent cartridges are discarded in the garbage which contributes to the contamination of the natural environment. In order to alleviate the above problems, the users of inkjet printers seek to refill the consumed cartridges rather than replacing them with new cartridges so as to reduce the operating cost as well as the unnecessary discarding of the used cartridges. However, when the printer can no longer extract ink from an ink cartridge, there is actually still a trace of ink remaining within the cartridge. Such small amount of ink remnant would quickly become dry up to blockage at the cartridge nozzle and hardening of the carrier material particularly adjacent to the nozzle. When fresh ink is injected into the cartridge for refilling it under such condition, the harden carrier material would loose the required physical characteristic for holding the ink and delivering it to the print head under vacuum. Furthermore, the dry up remnant of ink at the nozzle also form blockage to impede the flow of ink out of the cartridge.

For the above reason, it has been problematic in the refilling of ink cartridges in that the nozzle of the cartridge without resolving the above problems. The blockage at the nozzle may be removed by cleaning the nozzle external surface with water if the cartridge is to be refilled as soon as the ink has been consumed. However, cleaning the nozzle externally often does not eliminate the blockage within the opening of the nozzle particularly when the cartridge has been removed from the printer for some time without refill it immediately. Also, it does not eliminate the hardening of the carrier material in the cartridge. Thus, the refilled cartridge either does not function or will only function inefficiently. Furthermore, the wiping operation would often destroy the physical structure of the nozzle.

Attempts have been made to remove the internal ink remnant from the cartridge by injecting hot water into the cartridge through the nozzle. However, since the openings of the nozzle of the cartridge are very small, such process is rather messy and unsatisfactory as very little amount of hot water would penetrate into the cartridge.

SUMMARY OF THE INVENTION

It is a principal object of the present invention to provide a process of refilling an inkjet printer cartridge such that it is clog-free and will function as efficiently as a new cartridge.

It is another object of the present invention to provide a process of removing clogging ink remnant completely from a consumed ink cartridge.

It is another object of the present invention to provide a process of cleaning the ink carrying medium within a consumed ink cartridge to revive its ink retaining characteristic.

It is yet another object of the present invention to provide a system of refilling an ink cartridge having a high ink delivery characteristic.

BRIEF DESCRIPTION OF THE DRAWINGS

Other objects and advantages of the present invention will become apparent from the following detailed description of the preferred embodiments thereof in connection with the accompanying drawings in which.

DETAILED DESCRIPTION OF THE PREFERRED EMBODIMENTS

Figure 1:
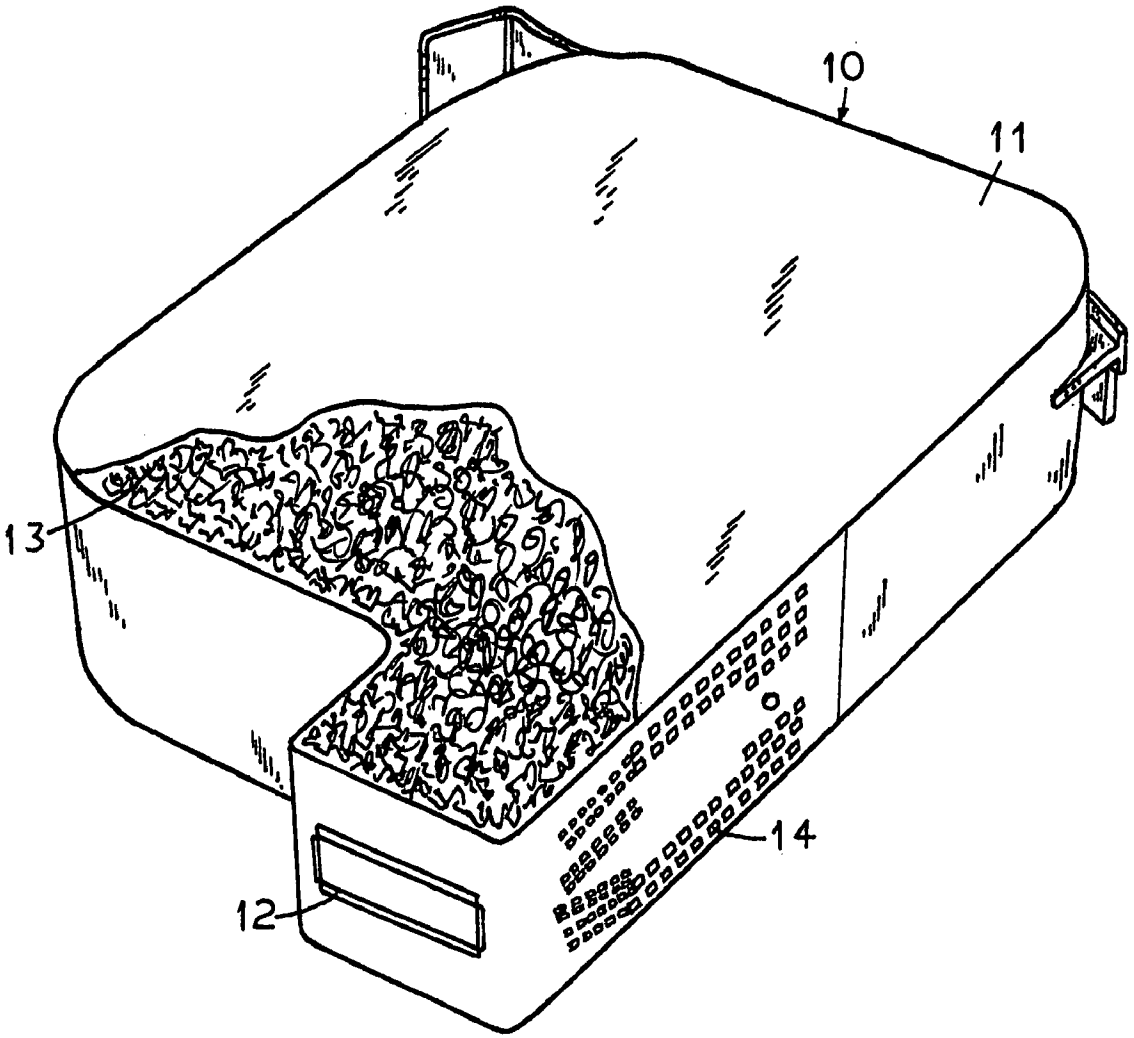
FIG. 1 is an enlarged front and bottom perspective elevation view of an inkjet cartridge with a portion of the enclosure removed to show the ink carrying medium located therein.

With reference to the drawings, an inkjet cartridge 10 has a casing 11 having a nozzle 12. Ink holding medium 13 such as foam fiber or similar material is commonly located within the casing 11. The medium 13 is saturated with ink when the cartridge is filled and it ensures that ink will be delivered to the print head of the printer satisfactorily. A pattern of electrical contacts 14 is provided on the casing 11 for actuating the ink delivery control system when the cartridge is inserted into the printer. When the ink is depleted in the cartridge, it must be replaced or refilled. Although an ink cartridge can no longer deliver ink to the print head for the printing operation, some ink actually still remain in the cartridge. Such remnant ink often forms blockage of the cartridge nozzle as well as hardening of the carrier medium 13 in the portion adjacent to the cartridge nozzle particularly if the cartridge is not refilled immediately. The harden carrier medium will eventually loose its capability of holding ink even when the cartridge is refilled and ink will no longer be delivered to the print head satisfactorily. Thus, in refilling the cartridge, the nozzle and the ink retaining foam must be thoroughly cleaned in order that the refilled cartridge would operate satisfactorily.

Figure 2:
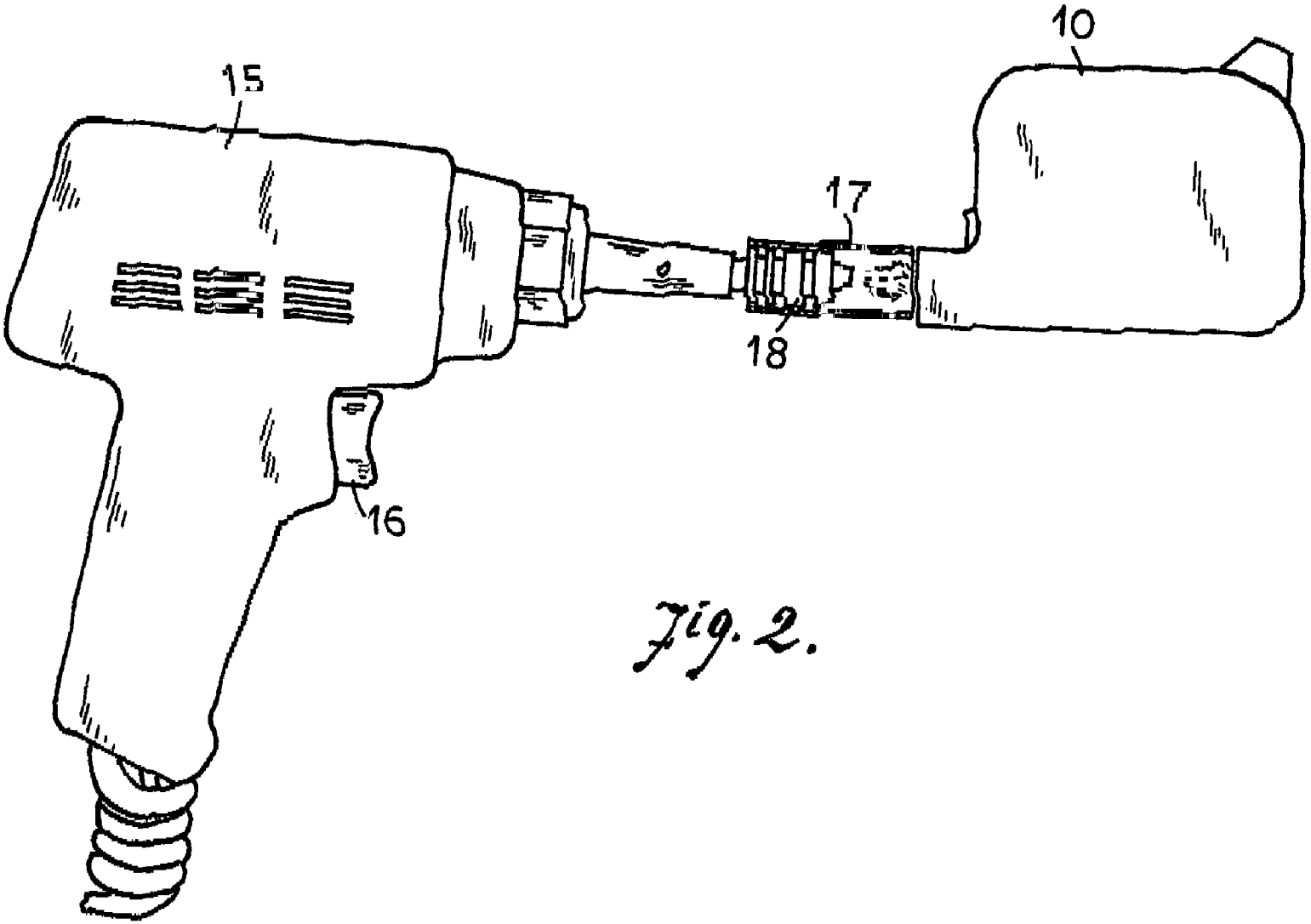
FIG. 2 is a perspective side elevation view of the system for cleaning the cartridge for remnant ink therein prior to refilling with ink according to the present invention with the steam guard tube shown in partial cross section.

According to the present invention, prior to refilling the consumed ink cartridge, it is first cleaned by injecting short bursts of steam with a steam pressure of from 5 to 45 psi with a temperature of about 100° C. through the nozzle 12. The steam may be provided with a handheld steam gun 15 having a manually operable trigger 16. The gun 15 is connected to a steam generator (not shown). This operation may be carried out quickly and easily with relatively small ink cartridges since the steam would breakdown any dry ink blockage formed at the nozzle and penetrate into the cartridge to clean the carrier medium so as to return it to its original physically characteristic of ink retention. A suction vacuum device similar to the gun 15 may then be applied at the nozzle to extract the cleaning steam water from the cartridge with a suction vacuum pressure of about 20 to 29 Hg. For relatively larger ink cartridges, in order to assure the penetration of the steam into the cartridge, a high temperature relatively soft silicone tube 17 is mounted over the steam nozzle 18 of the gun. The end of the soft silicone tube 17 is held in contact with the nozzle 12 of the cartridge 10 as best shown in FIG. 2 to serve as a guard to confine the steam over the area of the nozzle 12 of the cartridge 10. A hand operated steam gun 12 is shown as an example, it can be appreciated by those skilled in the art that the cartridge 10 may be mounted onto a steam generating device having silicone tube aligned in contact with the cartridge nozzle such that the steam may be injected into the cartridge by operating the steam generator. Steam under the desirable pressure will effectively be injected into the cartridge through the nozzle 12 to dissolve the remnant dry up ink from the nozzle as well as from the carrier medium. The entire operation may be carried out quickly without causing the dissolved ink and water from splashing over the cleaning station. The operation may be repeated until the ink remnant is completely eliminated from the cartridge.

Since the steam is applied to the cartridge in very short intervals, it would not cause deterioration of the ink carrier medium or the physical integrity of the nozzle structure since the nozzle is not touch physically in the entire operation.

Once the cartridge has been completely cleaned, it may then be refilled by temporarily blocking the nozzle 12 and then injecting the ink into the cartridge under pressure through a filling opening formed in a selected location of the casing 11. Commonly, the filling is carried out with an opening formed at a location opposite to the nozzle 12 so as to ensure the entire ink carrier medium 13 is saturated with the ink in the filling operation.

While the present invention has been shown and described in the preferred embodiments thereof, it will be apparent that various modifications can be made therein without departing from the spirit or essential attributes thereof, and it is desired therefore that only such limitations be placed thereon as are imposed by the appended claims.

What I claim is:

1. A process of refilling a consumed ink cartridge having an ink dispensing nozzle comprising:

appling steam under presure in the range of from 5 to 45 psi in short bursts to said dispensing nozzle through a hand operable steam gun having a soft silicone guard mounted over a steam outlet nozzle therein, said soft silicone guard tubing confining said steam to a restricted area around said dispensing nozzle with said silicone guard being held in close contact with said dispensing nozzle, for dissolving ink remnant in said dispensing nozzle and in an ink carrier medium located within said cartridge, applying a vacuum suction in the range of from 20 to 29 Hg at said dispensing nozzle for extracting ink remnant having dissolved in steam water produced by said steam.

blocking said dispensing nozzle and injecting ink into said cartridge after all ink remnant has been removed therefrom.

2. The process of refilling a consumed ink cartridge according to claim 1 wherein said steam has a temperature of about 100° C.

3. The process of refilling a consumed ink cartridge according to claim 2 including the step of closing said refilling opening.

* * * * *